US010184738B1

(12) United States Patent
Kellgren

(10) Patent No.: US 10,184,738 B1
(45) Date of Patent: Jan. 22, 2019

(54) HANDGUN WITH IMPROVED SLIDE

(71) Applicant: Kel-Tec CNC Industries, Inc., Cocoa, FL (US)

(72) Inventor: George Kellgren, Cocoa, FL (US)

(73) Assignee: Kel-Tec CNC Industries, Inc., Cocoa, FL (US)

( * ) Notice: Subject to any disclaimer, the term of this patent is extended or adjusted under 35 U.S.C. 154(b) by 0 days.

(21) Appl. No.: 15/976,229

(22) Filed: May 10, 2018

(51) Int. Cl.
*F41A 3/66* (2006.01)
*F41A 3/10* (2006.01)
*F41A 3/88* (2006.01)

(52) U.S. Cl.
CPC ..... *F41A 3/66* (2013.01); *F41A 3/10* (2013.01); *F41A 3/88* (2013.01)

(58) Field of Classification Search
CPC .... F41A 3/66; F41A 3/88; F41C 23/10; F41C 23/16; F41C 23/18
See application file for complete search history.

(56) References Cited

U.S. PATENT DOCUMENTS 5,042,185 A 8/1991 Justice, Sr.
5,088,222 A 2/1992 Larson
5,216,191 A 6/1993 Fox
5,320,023 A 6/1994 Erdem
5,465,645 A 11/1995 Cominolli
5,611,164 A * 3/1997 Rassias ..... F41A 17/44 42/70.11
5,955,696 A 9/1999 Meller
D479,570 S 9/2003 Scheunert
D505,476 S 5/2005 McGarry
D687,117 S 7/2013 Yigit
D692,513 S 10/2013 Yigit
D744,049 S 11/2015 Chu
D755,324 S 5/2016 Martelli et al.
D808,487 S 1/2018 Beville et al.
D814,596 S 4/2018 Curry
2002/0020100 A1* 2/2002 Roca ..... F41A 9/45 42/70.11
2005/0188585 A1* 9/2005 Vicate ..... F41C 3/00 42/71.01
2014/0075803 A1* 3/2014 Muller ..... F41A 11/02 42/16
2014/0338522 A1* 11/2014 Bellione ..... F41A 3/12 89/139

FOREIGN PATENT DOCUMENTS

WO WO-2015073492 A1 * 5/2015 ..... F41G 11/003

* cited by examiner

*Primary Examiner* — Stephen Johnson
(74) *Attorney, Agent, or Firm* — Brian S. Steinberger; Law Offices of Brian S. Steinberger, P.A.

(57) ABSTRACT

Handguns, pistols, devices, and methods with improved slides that are both less expensive and less complex than prior art hollow slides used in handguns. The pistol can be formed from two half sections that can be attached together with fasteners, such as screws. The half sections can include upper barrel half covers preformed with generally vertical grip halve parts. A novel L shaped slide assembly can be located between the attached upper barrel half covers.

18 Claims, 10 Drawing Sheets

10
20
30
35
40
45
50
52
58
60
65
70
80
90
100
110
115
120
130
140
150
160
170
180
190
200
210
220
230
240
250

HANDGUN WITH IMPROVED SLIDE

FIELD OF INVENTION

This invention relates to firearms, and in particular to handguns, pistols, devices, and methods with improved slides that are both less expensive and less complex than prior art hollow slides used in handguns.

BACKGROUND AND PRIOR ART

Popular modern self-loading handguns generally require a grip or receiver surrounding a vertically oriented magazine that holds cartridges ready to be fired. A horizontal barrel is located on top of and in front of the grip/receiver, and is rigidly mounted or actuated by a cam surface. The handgun usually requires a hollow slide that surrounds most of the barrel. In operation, the lateral motion of the hollow slide provides for the loading and ejection of the cartridges into the barrel. However, the slide has inherent problems.

FIG. 1 is rear right side perspective view of a conventional prior-art semi-automatic pistol 260. FIG. 2 is another rear right side perspective view of the prior art pistol 260 of FIG. 1 showing the machined slide 280 moves relative to the frame 270. FIG. 3 is a right bottom perspective view of the prior art pistol of FIG. 1 with the slide 280 lifted away.

FIG. 4 is an upper perspective view of the prior art slide 280 of FIG. 1. FIG. 5 is a lower perspective view of the prior art slide 280 of FIG. 4.

Referring to FIGS. 1-5, the slots 290 in the prior art slide 280 generally engage rails 300 on a machined frame 270. The rails 300 are generally machined on a conventional frame 270 engage the machined slide 280 and allow front to back motion of the slide 280 to the frame 270.

The machined frame 27 and the hollow machined slide 280 are generally complicated and expensive parts. The hollow machined slide 280 is usually milled out of high strength steel and is the most expensive cost part of the handgun 260, which contributes the largest cost part to the handgun 260. Additionally, the hollow machined slide 280 is the most complex component of the handgun.

Thus, the need exists for solutions to the above problems with the prior art.

SUMMARY OF THE INVENTION

A primary objective of the present invention is to provide handguns, pistols, devices, and methods with improved slides that is less expensive than prior art hollow slides used in handguns.

A secondary objective of the present invention is to provide handguns, pistols, devices, and methods with improved slides that are less complex than prior art hollow slides used in handguns.

A third objective of the present invention is to provide handguns, pistols, devices, and methods with improved slides that is easier to manufacture than prior art hollow slides used in handguns.

A fourth objective of the invention is to provide handguns, pistols, devices, and methods with improved slides, having L shapes that can be located between upper barrel half cover portions that are attached to one another.

A fifth objective of the invention is to provide handguns, pistols, devices, and methods with improved slides, that can be located between upper barrel half covers and grip halves that are attached to one another.

The semi-automatic pistol with improved slide assembly can comprise two generally symmetrical halves having upper horizontal portions that can surround a metal barrel with a trunnion and a mechanism housing. The halves can include generally vertical right and left grip half portions extending downward from the rear of the horizontal barrel cover portions. The grip half portions can form a vertical cavity into which a magazine can be inserted.

The right and left barrel cover portions can house a novel slide assembly. The slide assemble can be formed by an L-shaped flat metal with a horizontal bore at a front bent end to accept a gun barrel and vertical holes in the back of the slide assembly to accept a breech bolt and a low-density housing. The breech bolt can contain a firing pin and extractor that can be attached by pins and screws.

The slide assembly can be attached to the grip half portions by the frontal bore engaging the barrel and the breech bolt corresponding rails in the receiver. A pivoting buffer can limit the action of the slide assembly when the pistol is assembled.

A semi-automatic pistol with an improved slide, can include a left half section having a left barrel cover with a left grip portion, a right half section having a right barrel cover with a right grip portion, an elongated slide assembly with a recoil spring about a gun barrel, with a trigger mechanism for actuating the slide assembly, and members for attaching the left half section to the right half section, wherein actuating the trigger mechanism allows for the elongated slide assembly to move back and forth relative to a gun barrel within the left barrel cover and the right barrel cover.

The attaching members can be selected from at least one of screws and bolts and pins, for attaching the left half section to the right half section.

The elongated slide assembly can include an L shaped plate having a through bore at a bent front end to accept the barrel, and having a rear end, wherein the recoil spring is positioned behind the bent front end.

The rear end of the L shaped plate can include a breech bolt attached to a lower surface of the rear end of the L shaped plate.

The semi-automatic pistol can include fasteners selected from at least one of screws and bolts, for attaching the breech bolt to the rear end of the L shaped plate.

The semi-automatic pistol can include a fixed frame located in an upper portion of the left grip portion and the right grip portion, wherein the breech bolt is slidable relative to fixed frame.

The L shaped plate can be formed from metal, such as a single machined metal part.

The semi-automatic pistol can include a slide cover for covering the rear end of the L shaped plate.

The left half section and the right half section can each formed from molded plastic. The left half section and the right half section can each formed from injection molded plastic.

The semi-automatic pistol can include a safety lever for preventing the trigger mechanism from being actuated.

The semi-automatic pistol can include a left safety lever on the left half section and a right safety lever on the right half section.

A pistol with an improved slide, can include a barrel cover about a portion of a gun barrel, a grip extending below a rear portion of the barrel cover, an elongated slide assembly with a recoil spring about the gun barrel, the elongated slide assembly includes an L shaped plate having a through bore at a bent front end to accept the barrel and having a rear end, wherein the recoil spring is positioned behind the bent front end, and a trigger mechanism for actuating the slide assembly.

The rear end of the L shaped plate can include a breech bolt attached to a lower surface of the rear end of the L shaped plate.

The pistol with improved slide can include fasteners selected from at least one of screws and bolts, for attaching the breech bolt to the rear end of the L shaped plate.

The pistol with improved slide can include a fixed frame located in an upper portion of the grip, wherein the breech bolt is slidable relative to fixed frame.

The barrel cover can include a left half barrel cover fastened to a right half barrel cover, that are each formed from plastic.

The grip cover can include a left half grip cover fastened to a right half grip cover, that are each formed from plastic.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
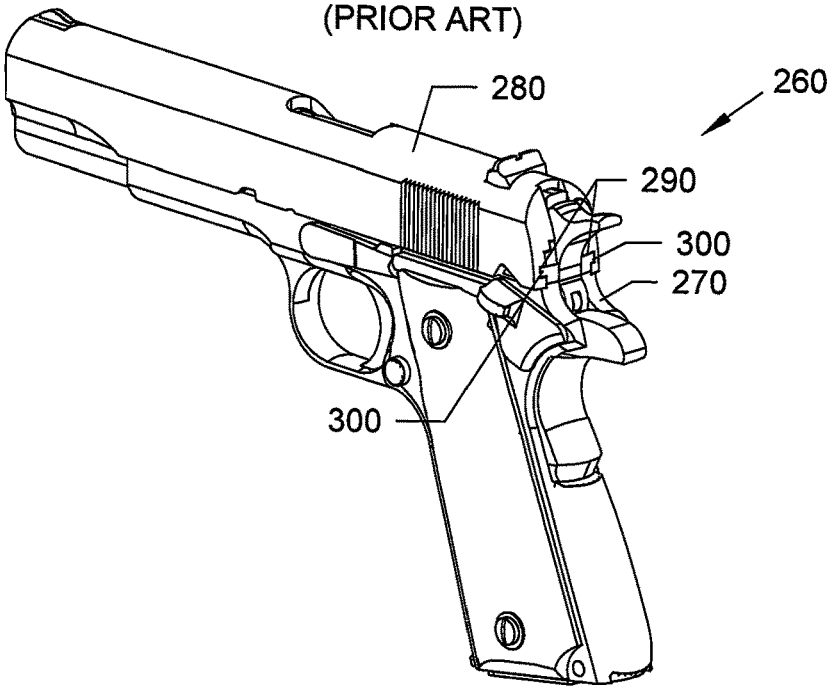
FIG. 1 (PRIOR ART)
FIG. 1 is rear right side perspective view of a conventional prior-art semi-automatic pistol.
Figure 2:
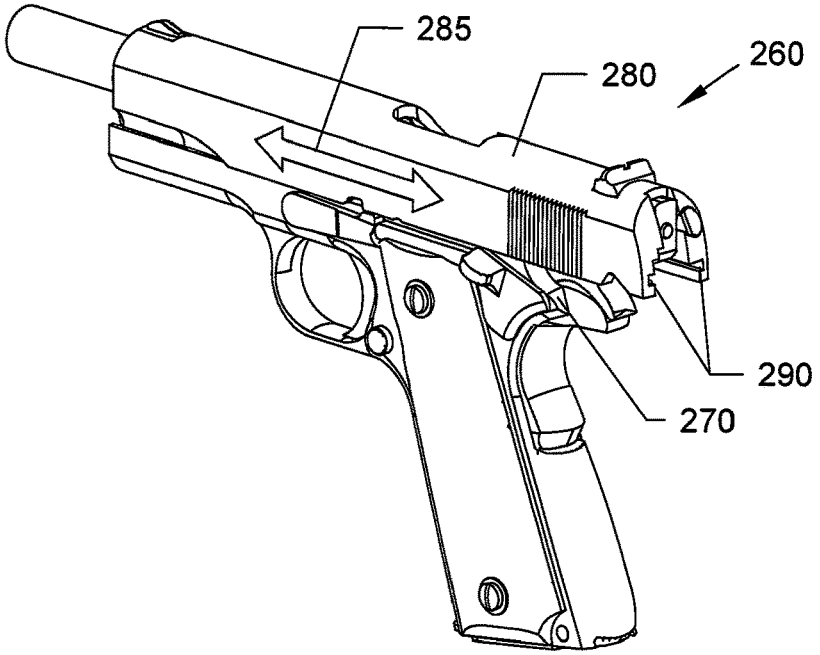
FIG. 2 (PRIOR ART)
FIG. 2 is another rear right side perspective view of the prior art pistol of FIG. 1 showing the machined slide moves relative to the frame.
Figure 3:
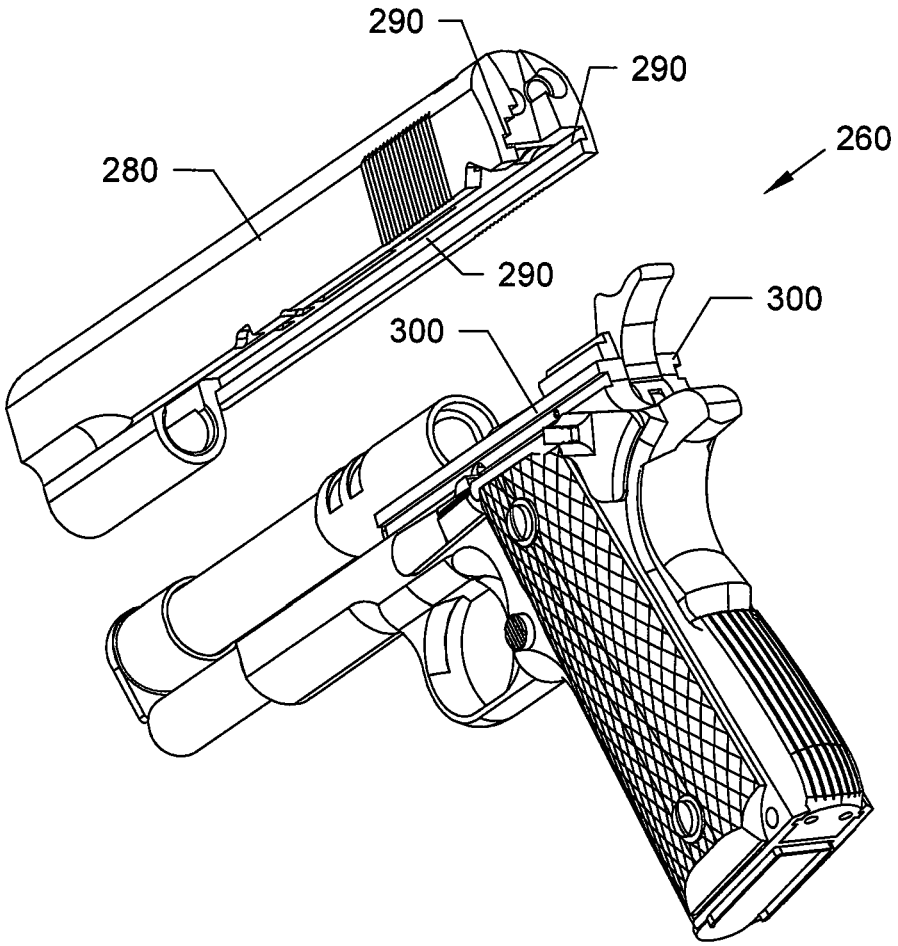
FIG. 3 (PRIOR ART)
FIG. 3 is a right bottom perspective view of the prior art pistol of FIG. 1 with the slide lifted away.
Figure 4:
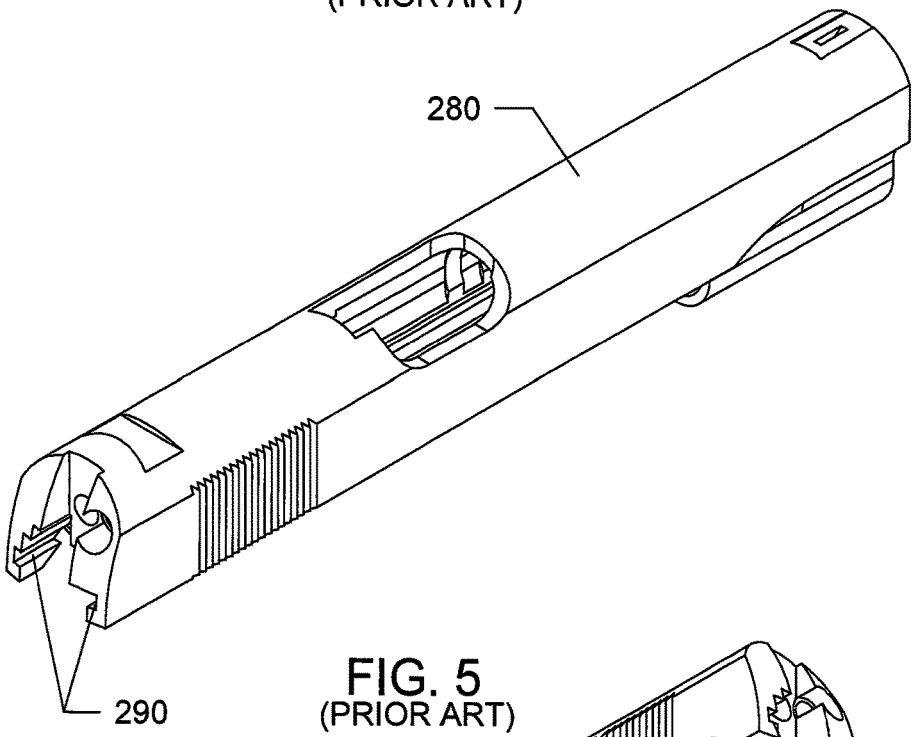
FIG. 4 (PRIOR ART)
FIG. 4 is an upper perspective view of the prior art slide used in the pistol FIG. 1.
Figure 5:
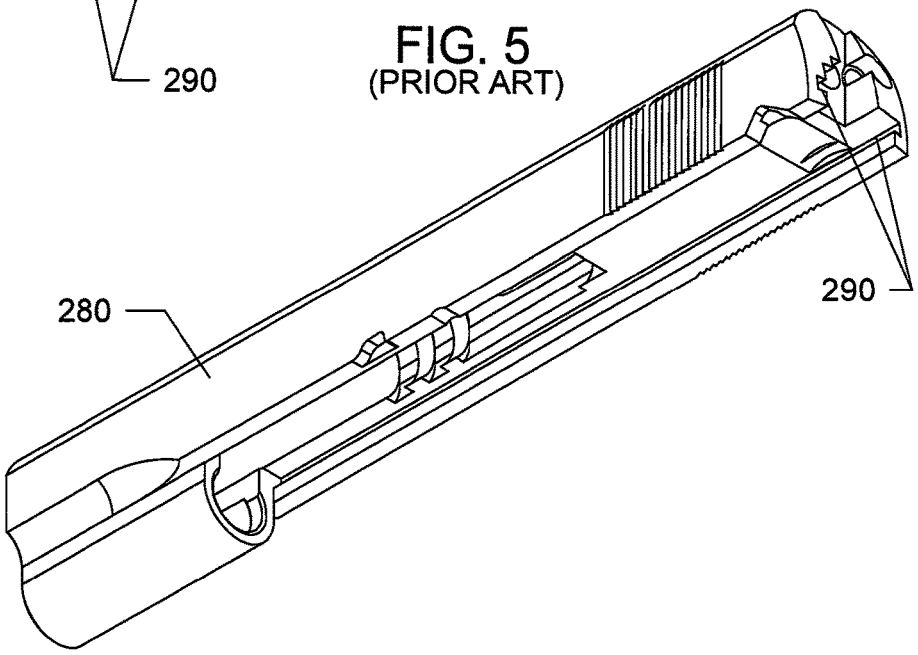
FIG. 5 (PRIOR ART)
FIG. 5 is a lower perspective view of the prior art slide of FIG. 4.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 semi-automatic pistol.
20 Slide assembly.
25 Slide motions relative to frame of pistol.
30 Left grip.
35 Left barrel cover.
40 Right grip.
45 Right barrel cover.
50 Slide top/L shaped flat plate
52 Front bent end of L shaped plate
55 Hole/through bore in front bent end of the slide top/L shaped top, for barrel
58 Rear end of L shaped plate
60 Frame.
65 Frame tabs engages slots 115 in bolt 110.
70 Barrel.
80 Trunnion.
85 Slots in barrel engage spring pins in trunnion to secure barrel.
90 Slide bushing.
95 Muzzle nut.
100 Recoil spring.
110 Bolt.
115 Bolt slots engage frame tabs and allow front to back motion of slide assembly relative to frame.
120 Buffer prevents over-travel of slide assembly rearward.
130 Slide cover.
140 Spring pin, trunnion-to-barrel.
150 Spring pin, slide top-to-bolt.
160 Buffer spring.
170 Screw, slide top & slide cover.
180 Front sight assembly.

190 Screw, front sight assembly.
200 Rear sight assembly.
210 Safety lever, left hand.
215 Safety lever, right hand.
220 Safety lever mounting screw.
230 Grip mount screw.
240 Grip-trunnion screw.
250 Grip-barrel screw.
260 Conventional semi-automatic pistol.
270 Machined frame for conventional semi-automatic pistol.
280 Machined slide for conventional semi-automatic pistol.
285 Slide motion relative frame of pistol.
290 Slots in conventional slide engage rails on machined frame.
300 Rails machined on conventional frame engage machined slide and allow front to back motion of slide to frame.

Figure 6:
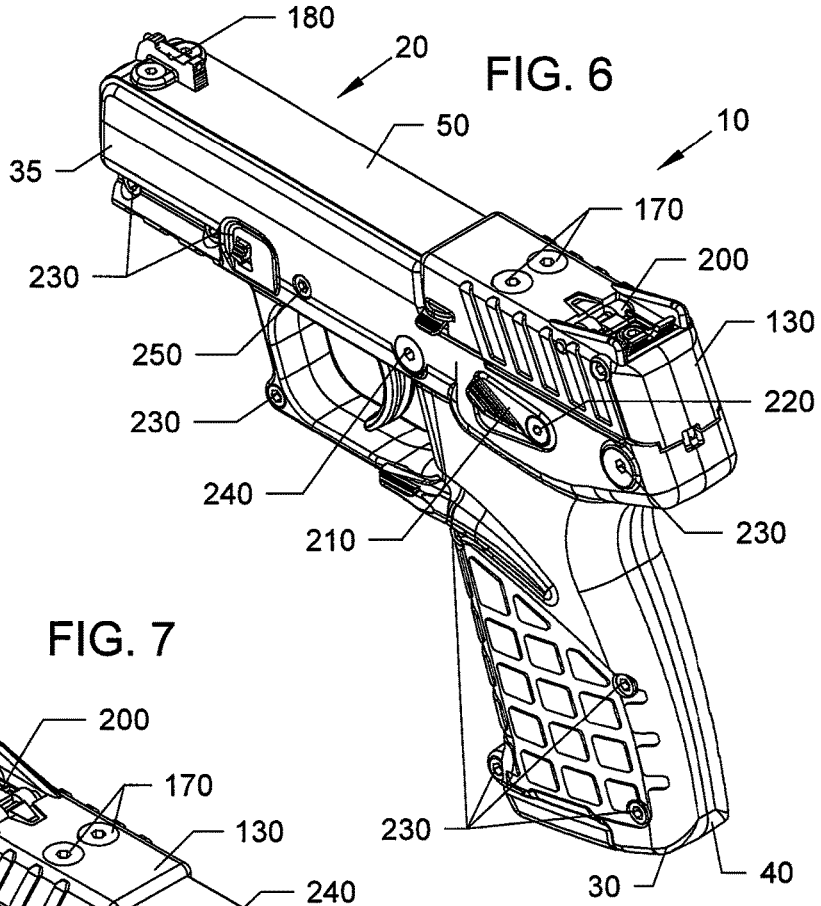
FIG. 6 is an upper rear right perspective view of a semi-automatic pistol assembly with the improved slide.
Figure 7:
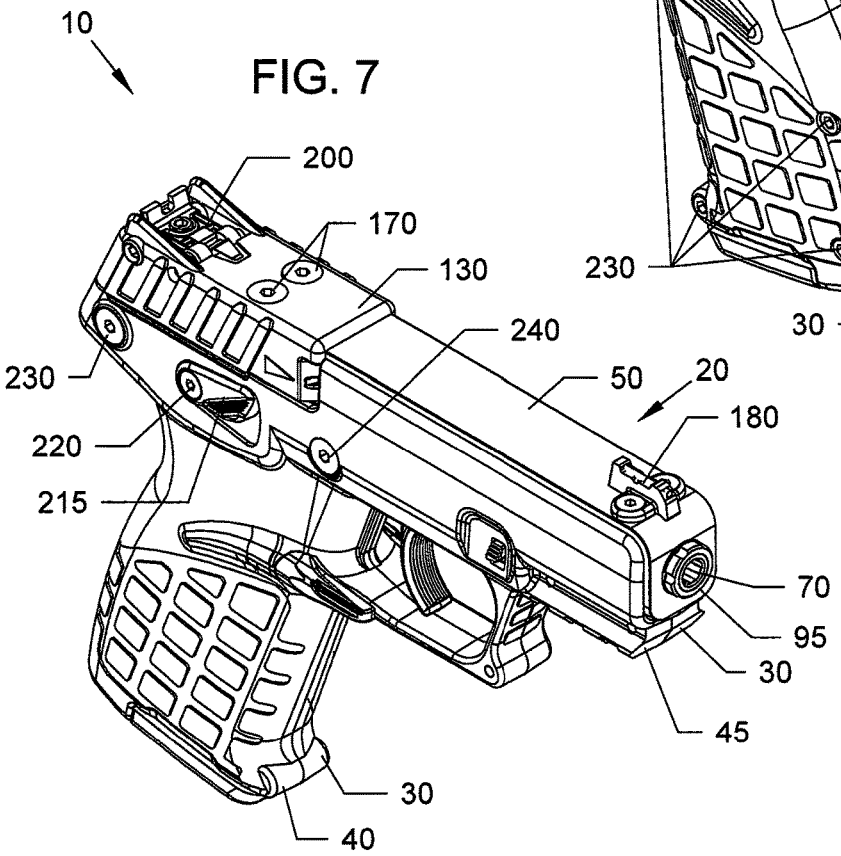
FIG. 7 is an upper front left perspective view of the pistol with improved slide of FIG. 6.
Figure 8:
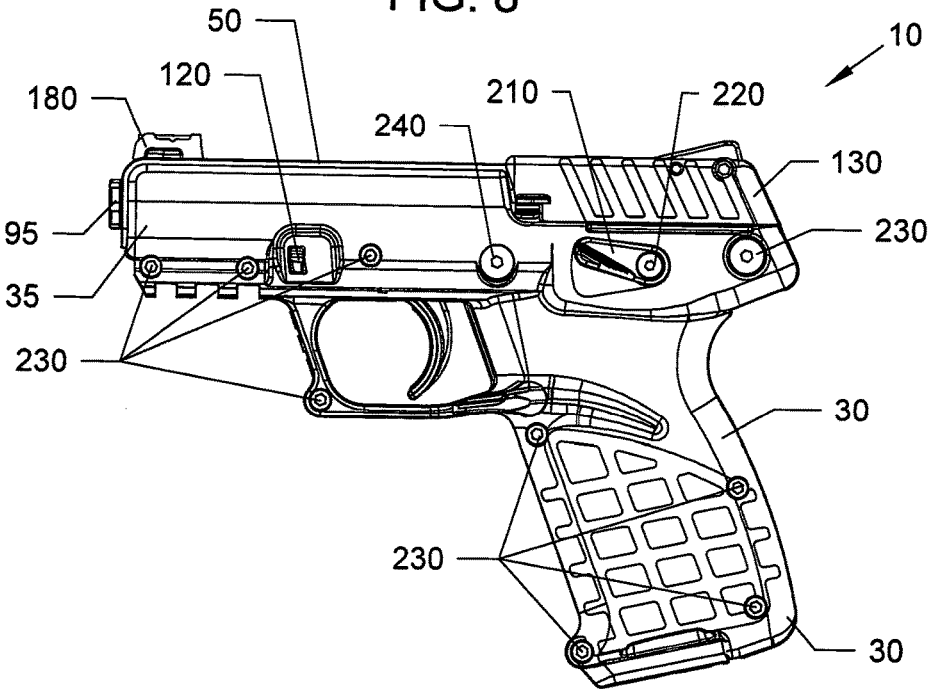
FIG. 8 is a right side view of the pistol with improved slide of FIG. 6.
Figure 9:
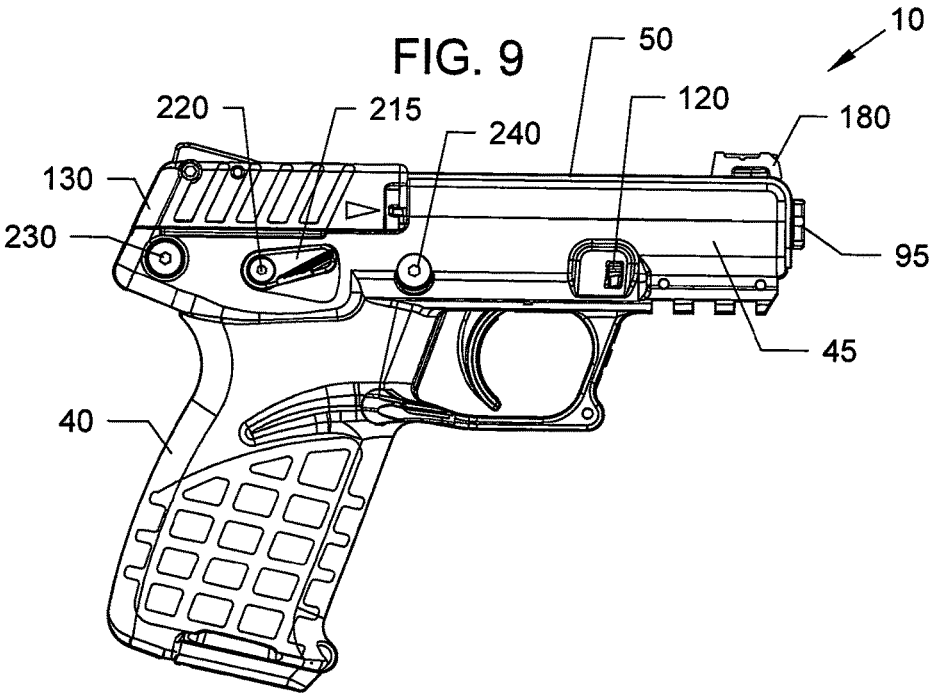
FIG. 9 is a left side view of the pistol with improved slide of FIG. 6.
Figure 11:
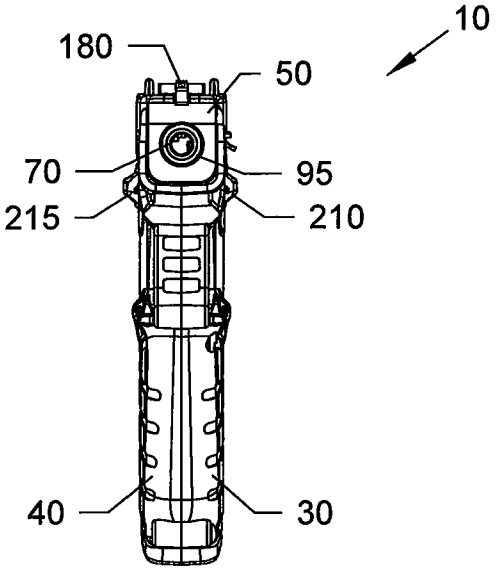
FIG. 11 is a front end view of the pistol with improved slide of FIG. 6.
Figure 10:
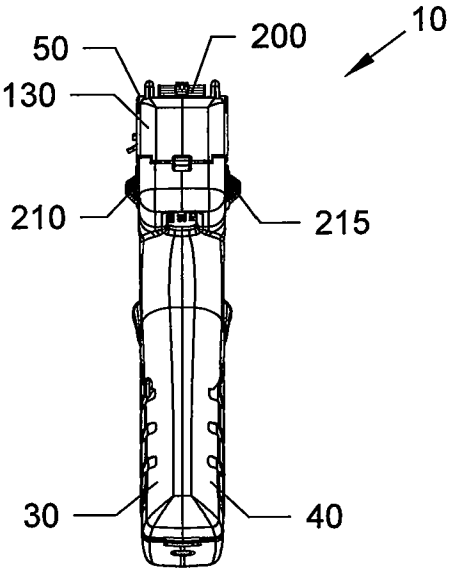
FIG. 10 is a rear end view of the pistol with improved slide of FIG. 6.
Figure 12:
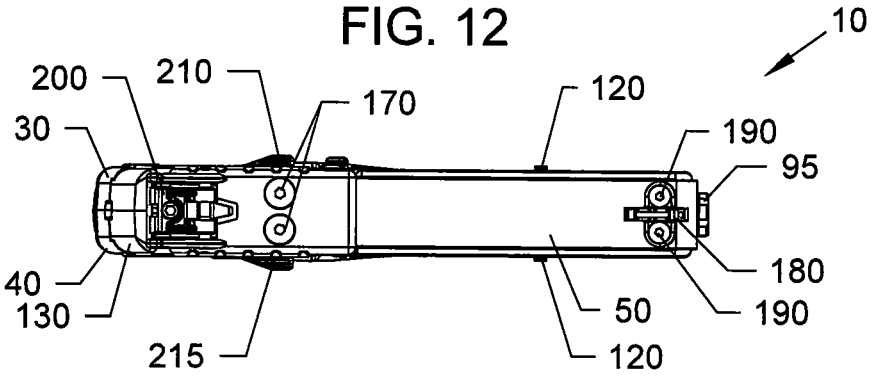
FIG. 12 is a top view of the pistol with improved slide of FIG. 6.
Figure 13:
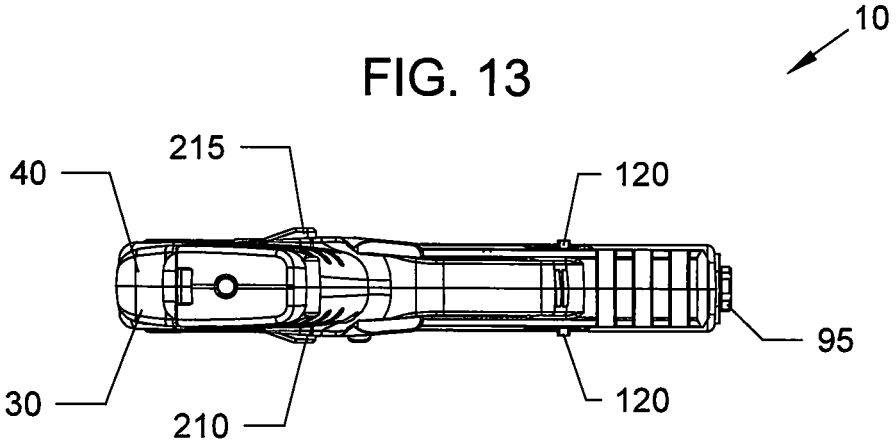
FIG. 13 is a bottom view of the pistol with improved slide of FIG. 6.

FIG. 6 is an upper rear right perspective view of a semi-automatic pistol 10 with and improved slide assembly 20. FIG. 7 is an upper front left perspective view of the pistol 10 with the improved slide assembly 20 of FIG. 6. FIG. 8 is a right side view of the pistol 10 with the improved slide assembly 20 of FIG. 6. FIG. 9 is a left side view of the pistol 10 with the improved slide assembly 20 of FIG. 6. FIG. 10 is a rear end view of the pistol 10 with improved slide assembly 20 of FIG. 6. FIG. 11 is a front end view of the pistol 10 with the improved slide assembly 20 of FIG. 6. FIG. 12 is a top view of the pistol 10 with the improved slide assembly 20 of FIG. 6. FIG. 13 is a bottom view of the pistol 10 with the improved slide assembly 20 of FIG. 6.

Referring to FIGS. 6-13, the pistol 10 can include but not limited to a P-17 semi-automatic pistol, and the like, in an assembled position, having a left grip 30 with an upper generally horizontal left barrel cover 35 that is attached to a right grip 40 with an upper generally horizontal right barrel cover 45 by grip mount screws 230. The slide assembly 20 includes a slide top 50, with screws 170 for the slide top 50 and slide cover 130, with the rest of the components of the slide assembly 20 to be shown and described in later figures. A vertical cavity can be formed between the attached right and left grips 30, 40. A magazine, such as those shown and described in U.S. Pat. No. 5,320,023 to Erdem, which is incorporated by reference in its' entirety.

The front top of the barrel portion of the pistol 10 can include a front sight assembly 180, and the top rear of the pistol 10 can include a slide cover 130 with a rear sight assembly 200. On both the upper right and upper left sides of the grips 30, 40 can be respective left hand safety lever 210 and right hand safety lever 215, each mounted by respective safety lever mounting screw 220. The safety levers 210, 215 can function similarly to safety mechanisms shown and described in U.S. Pat. No. 5,088,222 to Larson and U.S. Pat. No. 5,042,185 to Justice, Sr., which are incorporated by reference in their entirety.

Forward of the safety levers 210, 215 can be respective grip-trunion screw(s) 240, with a grip barrel screw 250 on the left side of the barrel portion of pistol 10. And forward of grip-trunion screw(s) 240 can be a buffer 120 which prevents over-travel of the slide assembly 20 rearward. Extending out from the front of the barrel portion of pistol 10 can be a barrel 70, held by muzzle nut 95.

Figures 14, 15:
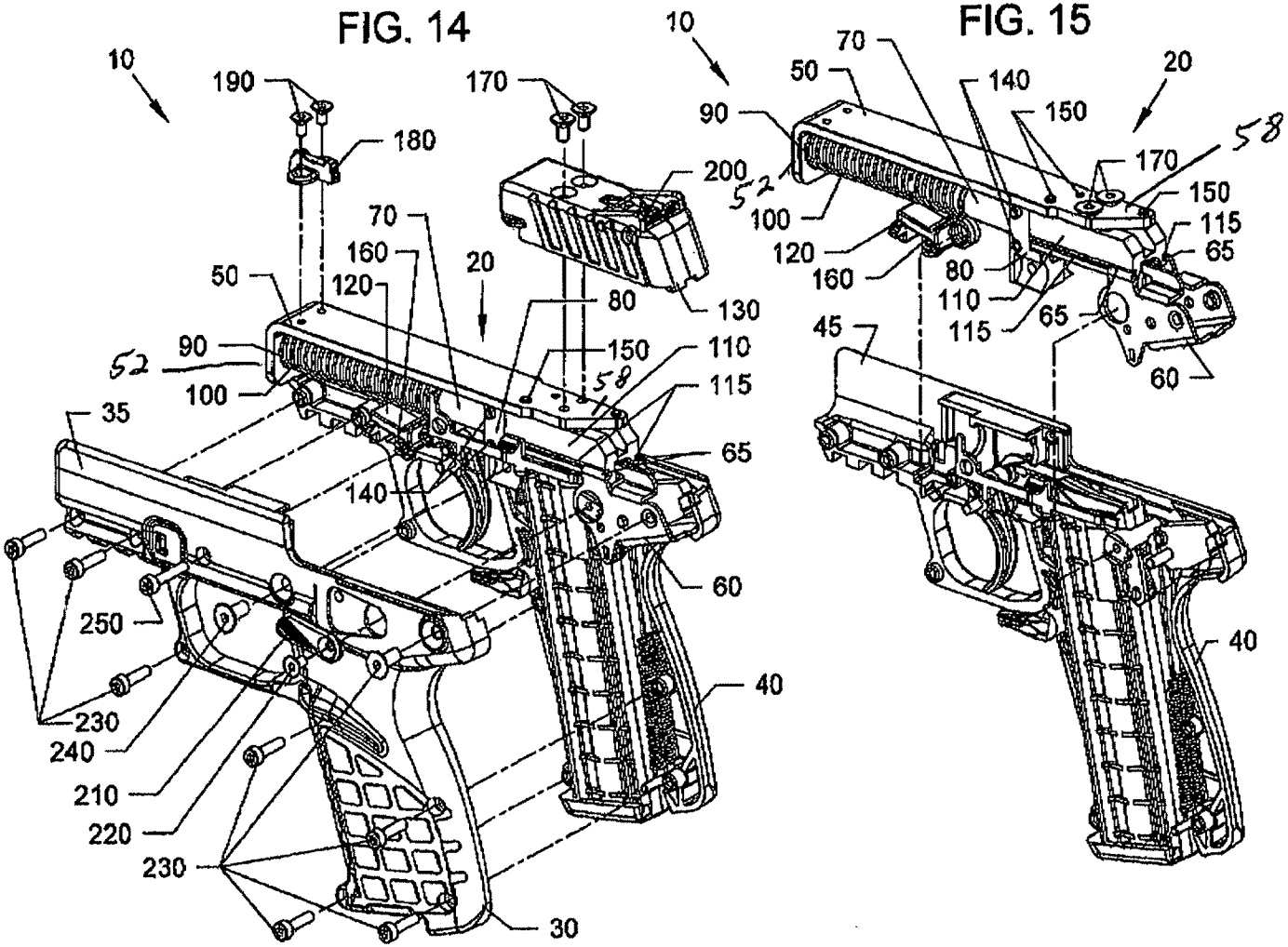
FIG. 14 is a top right perspective view of the pistol with improved slide of FIG. 6 with left grip and slide cover removed from the right grip.
FIG. 15 is another view of the right grip of the pistol of FIG. 14 with the slide assembly removed.

FIG. 14 is a top right perspective view of the pistol 10 with improved slide assembly 20 of FIG. 6 with left generally vertical grip 30 with upper generally horizontal barrel cover 35, and the slide cover 130 removed from the right grip 40 with the generally horizontal barrel cover 45. When the pistol 10 is assembled, the left grip 30 with left barrel cover 35 and right grip 40 with right barrel cover 45 are secured to the frame 60 and bolt 110 with screws 230. This combination of components comprises the body of the new pistol 10 and replace the more expensive frame and grips of a conventional semi-automatic pistol previously shown and described in reference to FIGS. 1-5.

FIG. 15 is another view of the right grip 40 of the pistol 10 of FIG. 14 with the slide assembly 20 removed. This set of components will be used in subsequent figures to show how the new slide assembly 20 interacts with the frame 60 and bolt 110 (and thereby the body of the pistol).

Figure 16:
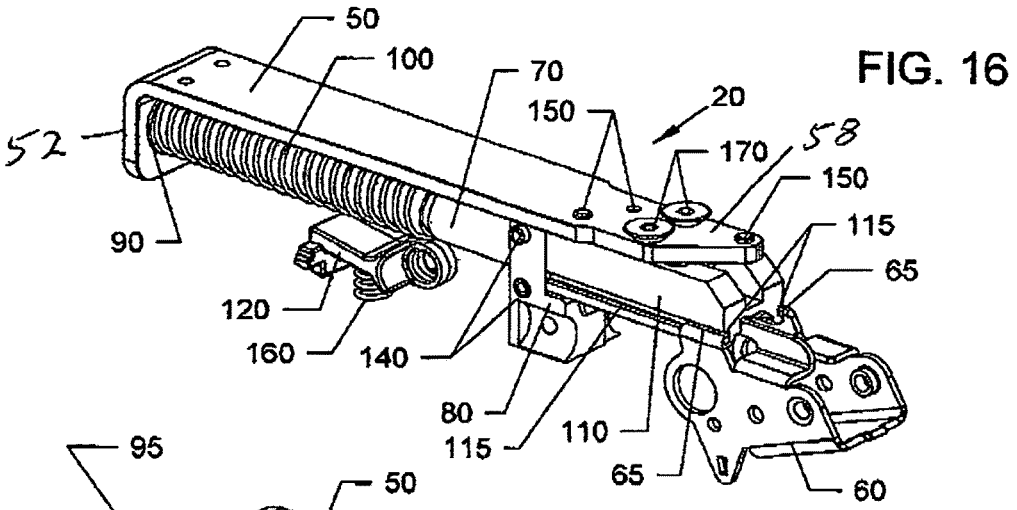
FIG. 16 is an enlarged perspective view of the slide assembly of FIG. 15.

FIG. 16 is an enlarged perspective view of the slide assembly 20 of FIG. 15.

Figure 17:
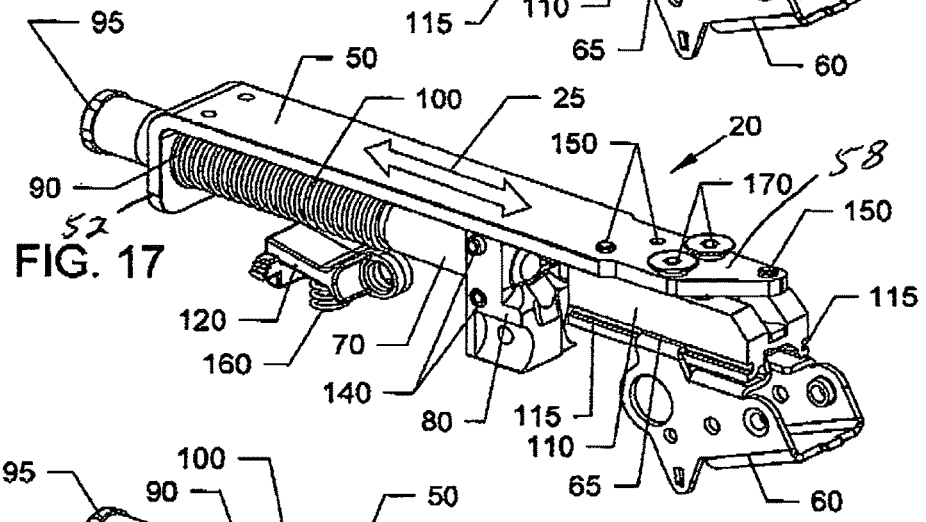
FIG. 17 is another perspective view of the slide assembly of FIG. 16 with the slide assembly starting to travel rearward.

FIG. 17 is another perspective view of the slide assembly 20 of FIG. 16 with the slide assembly 20 starting to travel rearward. FIG. 17 how the slide assembly 20 is secured to the body (bolt 110) of the pistol 10 while enabled to move forward and rearward as shown by double direction arrow 25. A slide top/L shaped flat plate 50 can include a front bent end 52 with a hole 55 for the front end of the barrel 70 and a rear end 58 of the slide top/L shaped flat plate 50. The hole/through bore 55 in the front of the slide top/L shaped flat plate 50 slides over the barrel 70 and is able to travel forward and rearward being guided by the barrel 70. The rear end of the slide top/L shaped flat plate 50 is secured to the bolt 110 by screws 170 which is captured by the tabs in the frame 60. The slots 115 in the bolt 110 allow it to travel forward and rearward sliding and being guided by the tabs 65 on the frame 60.

Figure 18:
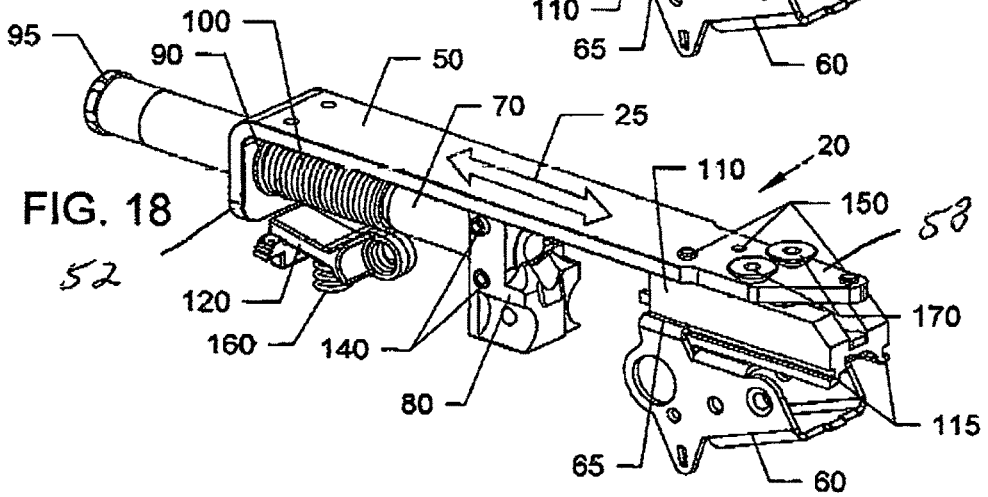
FIG. 18 is another perspective view of the slide assembly of FIG. 17 with the slide assembly slid all the way to the rear.

FIG. 18 is another perspective view of the slide assembly 20 of FIG. 17 with the slide assembly 20 slid all the way to the rear. The buffer 120 prevents the slide assembly 20 from disengaging from the frame tabs 65. Buffer 120 when depressed can allow for the disassembly of slide assembly 120 from the barrel 70. Spring pin 150 attaches top plate 50 to bolt 110 to those components attached to one another.

Figure 19:
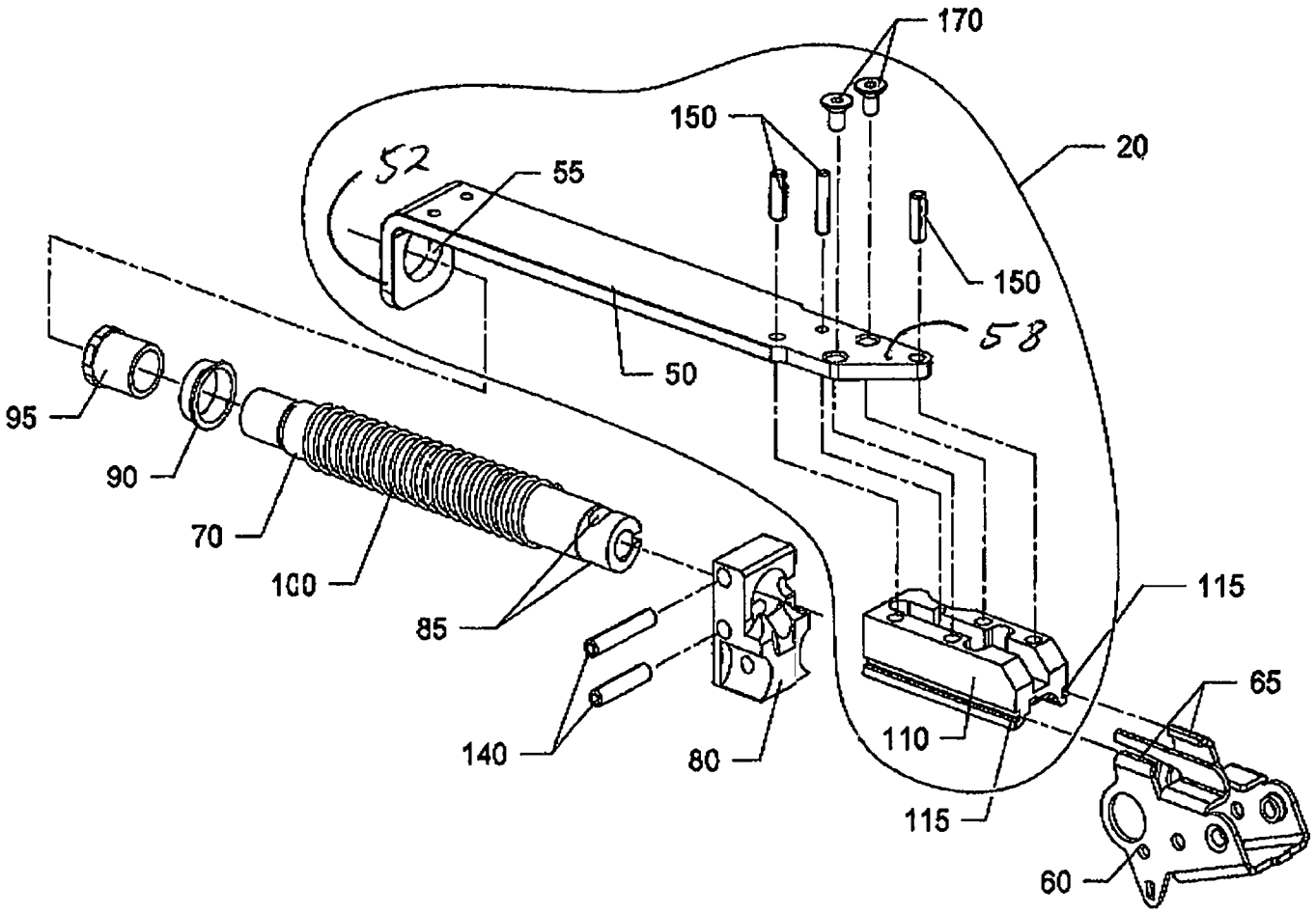
FIG. 19 is an exploded view of the slide assembly of the preceding FIGURES.

FIG. 19 is an exploded view of the slide assembly 20 of the preceding FIGURES.

Referring to FIGS. 14-19, slots 85 in barrel 70 engage spring pins 140 in the trunnion 80 to secure barrel 70. The front end of the barrel 70 can include slide bushing 90 with an exposed muzzle nut 95. A recoil spring 100 allows for the slide 20 to recoil back to the initial position after the pistol trigger is pulled. The recoil spring 100 can function similarly to recoil springs and slides shown and described in U.S. Pat. No. 5,955,696 to Meller; U.S. Pat. No. 5,465,645 to Cominolli, which are incorporated by reference in their entirety. The trigger shown in the pistol 10 can be similar to known triggers shown and described in U.S. Pat. No. 5,320,023 to Erdem; U.S. Pat. No. 5,216,191 to Fox; U.S. Pat. No. 5,088,222 to Larson, which are incorporated by reference in their entirety.

As shown in FIG. 14, screws 190 attach the front sight assembly 180 to the top front of the slide top 50.

Referring to FIGS. 6-19, the complicated and expensive machined part 270 of the prior art pistol 260 (FIGS. 1-5) is replaced by two plastic injection molded parts (left grip 30 and right grips 40) and a simple formed metal part (frame 60) in the pistol 10. These parts 30, 40 allows for ease of manufacturing and economy as compared to the parts in the prior art pistols.

Additionally, the machined slide 280 of the prior art pistol 26 (FIGS. 1-5) is a complicated and expensive part that is replaced by a simple formed metal part (slide top 50) and a simpler machined part (bolt 110). These parts 50, 110 additionally provides for ease of manufacturing and economy as compared to the parts in the prior art pistols.

A preferred embodiment of the left grip 30 and left barrel cover (left half section) and the right grip 40 and right barrel cover (right half section) can be formed from plastic materials, such as but not limited to polymers, polymer compositions, and the like. And a preferred embodiment of the pistol 10 can include the slide assembly 20, barrel 70 and bolt 110 can be the only main parts formed from metal. As such, the novel pistol 10 can have an approximate overall weight of less than approximately one pound, such as approximately 11 ounces.

The novel pistol 10 can be a small caliber pistol, such as a 22 or 32 caliber pistol.

Although the preferred embodiments show and describe screws and pins to fasten parts together, other types of fasteners can be used, such as but not limited to bolts, interlocking snap parts, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A semi-automatic pistol with an improved slide, comprising:

a left half section having a left barrel cover with a downwardly extending left grip portion;

a right half section having a right barrel cover with a downwardly extending right grip portion;

an elongated slide assembly with a recoil spring about a gun barrel, with a trigger mechanism for actuating the slide assembly, the elongated slide assembly includes an L shaped plate having a through bore at a single bent front end to accept the barrel, and having a rear end, and wherein the recoil spring is positioned behind the single bent front end; and members attaching the left half section to the right half section, wherein actuating the trigger mechanism allows for the elongated slide assembly to move back and forth relative to said gun barrel within the left barrel cover and the right barrel cover.

2. The semi-automatic pistol with improved slide of claim 1, wherein the attaching members are selected from at least one of screws and bolts and pins, for attaching the left half section to the right half section.

3. The semi-automatic pistol with improved slide of claim 1, wherein the rear end includes:

a breech bolt attached to a lower surface of the rear end of the L shaped plate.

4. The semi-automatic pistol with improved slide of claim 3, further comprising:

fasteners selected from at least one of screws and bolts, for attaching the breech bolt to the rear end of the L shaped plate.

5. The semi-automatic pistol with improved slide of claim 3, further comprising:

a fixed frame located in an upper portion of the left grip portion and the right grip portion, wherein the breech bolt is slidable relative to said fixed frame.

6. The semi-automatic pistol with improved slide of claim 1, wherein the L shaped plate is formed from metal.

7. The semi-automatic pistol with improved slide of claim 1, wherein the L shaped plate is formed from a single machined metal part.

8. The semi-automatic pistol with improved slide of claim 1, further comprising:

a slide cover for covering the rear end of the L shaped plate.

9. The semi-automatic pistol with improved slide of claim 1, wherein the left half section and the right half section are each formed from molded plastic.

10. The semi-automatic pistol with improved slide of claim 1, wherein the left half section and the right half section are each formed from injection molded plastic.

11. The semi-automatic pistol with improved slide of claim 1, further comprising:

a safety lever for preventing the trigger mechanism from being actuated.

12. The semi-automatic pistol with improved slide of claim 11, wherein the safety lever includes:

a left safety lever on the left half section; and a right safety lever on the right half section.

13. A pistol with an improved slide, comprising:

a barrel cover about a portion of a gun barrel;

a grip extending below a rear portion of the barrel cover;

an elongated slide assembly with a recoil spring about the gun barrel, the elongated slide assembly includes an L shaped flat plate having a through bore at a single bent front end to accept the barrel, and having a rear end, wherein the recoil spring is positioned behind the single bent front end; and a trigger mechanism for actuating the slide assembly.

14. The pistol with improved slide of claim 13, wherein the rear end includes:

a breech bolt attached to a lower surface of the rear end of the L shaped plate.

15. The pistol with improved slide of claim 14, further comprising:

fasteners selected from at least one of screws and bolts, for attaching the breech bolt to the rear end of the L shaped plate.

16. The pistol with improved slide of claim 13, further comprising:

a fixed frame located in an upper portion of the grip, wherein the breech bolt is slidable relative to said fixed frame.

17. The pistol with improved slide of claim 13, wherein the barrel cover includes:

a left half barrel cover fastened to a right half barrel cover, that are each formed from plastic.

18. The pistol with improved slide of claim 17, wherein the grip cover includes:

a left half grip cover fastened to a right half grip cover, that are each formed from plastic.

* * * * *